US006893181B1

(12) United States Patent
Duez et al.

(10) Patent No.: US 6,893,181 B1
(45) Date of Patent: May 17, 2005

(54) NIB AND METHODS OF TREATING AN ELONGATE ELEMENT DESIGNED TO FORM SUCH A NIB

(75) Inventors: José Duez, Boulogne sur Mer (FR); Vincent Bedhome, Desvres (FR); Philippe Chavatte, Hesdin-l'Abbe (FR)

(73) Assignee: CONTE, Cedex (FR)

( * ) Notice: Subject to any disclaimer, the term of this patent is extended or adjusted under 35 U.S.C. 154(b) by 0 days.

(21) Appl. No.: 10/009,885

(22) PCT Filed: May 12, 2000

(86) PCT No.: PCT/FR00/01294

§ 371 (c)(1),
(2), (4) Date: Jan. 22, 2002

(87) PCT Pub. No.: WO00/69654

PCT Pub. Date: Nov. 23, 2000

(30) Foreign Application Priority Data

May 14, 1999 (FR) ..... 99 06312

(51) Int. Cl.[7] ..... B43K 5/00; B43K 8/08; B43M 11/06

(52) U.S. Cl. ..... 401/199; 401/198; 401/207; 156/180

(58) Field of Search ..... 401/198, 199, 401/207; 156/166, 180, 274.6, 181, 379.9, 156/441

(56) References Cited

U.S. PATENT DOCUMENTS

| | | | | |
|---|---|---|---|---|
| 3,400,998 | A * | 9/1968 | Daugherty et al. | 401/198 |
| 3,442,739 | A * | 5/1969 | Johnson | 156/180 |
| 3,556,888 | A * | 1/1971 | Goldsworthy | 156/180 |
| 3,864,183 | A * | 2/1975 | Hori | 156/180 |
| 4,453,849 | A * | 6/1984 | Fernandez | 401/189 |
| 4,597,932 | A * | 7/1986 | Kurihara et al. | 264/145 |
| 4,973,182 | A * | 11/1990 | Nakano | 401/199 |

FOREIGN PATENT DOCUMENTS

| | | |
|---|---|---|
| EP | 0 726 166 | 8/1996 |
| EP | 0 857 586 | 8/1998 |
| FR | 1 418 087 | 2/1966 |
| FR | 1 476 355 | 6/1967 |
| FR | 1 550 995 | 12/1968 |
| GB | 1 152 342 | 5/1969 |

* cited by examiner

*Primary Examiner*—Tuan Nguyen
(74) *Attorney, Agent, or Firm*—Weingarten, Schurgin, Gagnebin & Lebovici LLP

(57) ABSTRACT

The nib is constituted by a segment of a coherent, elongate element of high porosity material, with at least a first end shaped to form a writing tip. The pores and/or capillaries of said material are blocked over a limited thickness e in particular in the range 0.01 mm to 1 mm, at the longitudinal outer periphery of the elongate element, with the exception of the first end forming a writing tip. In a first variant, blocking is obtained by a sealing agent and performed by continuously impregnating the elongate element with a sealing bath, and setting the agent. In a second variant, the nib is constituted by sintered microbeads and blocking is obtained by localized hot-melting of the microbeads.

7 Claims, 1 Drawing Sheet

NIB AND METHODS OF TREATING AN ELONGATE ELEMENT DESIGNED TO FORM SUCH A NIB

The present invention relates to the field of writing implements, and more particularly to high porosity nibs ensuring the transfer of ink from a liquid ink reservoir or a fibrous reservoir to the end of said nib serving as the writing tip.

BACKGROUND OF THE INVENTION

The nib necessarily projects from the body of the implement that the user holds while writing. The ink consumed on the writing medium is replaced as it is being used by ink coming from the reservoir and transferred by capillarity into the nib. When the implement is no longer in use, a cap is fitted onto the body of the implement in such a manner as to cover the nib, firstly to protect it from possible impacts and secondly to prevent it from drying out. If the projecting end of the nib remains in the open air, the solvent of the ink which is situated in the end evaporates whilst the pigment of the ink remains therein. That phenomenon can be detrimental in the sense that it may be difficult, or indeed even impossible, to make further use of the implement, even when a significant quantity of ink remains in the reservoir.

To avoid that drawback, manufacturers of writing implements have already proposed a certain number of solutions for increasing the length of time it is possible to leave a nib in the open air without any major difficulty in using the implement again.

A first solution consists in modifying the composition of the ink by adding additives of the film-forming type. During evaporation of the solvent, a film is formed on the surface of the nib which limits further evaporation, said film being very fragile so that it is eliminated when the user applies the nib once again on the writing medium.

A similar solution is adopted in document J 54019826 in which the nib is coated in a high polymer that is gastight and easy to peel off. By way of example, the high polymer can be a copolymer resin of vinyl chloride and of vinyl acetate, or an EVA copolymer resin. In that document, such a coating is provided merely to prevent the ink from evaporating, and the nib from drying out during storage and transport of the writing implements, given that the high polymer coating is easily removed before use.

OBJECTS AND SUMMARY OF THE INVENTION

The first object set by the Applicant is to propose a nib which mitigates the above-mentioned drawback by significantly increasing the length of time it is possible to leave said nib in the open air, without any effects that prevent the implement being used.

This object is fully achieved by the nib which, in known manner, is constituted by a segment of an elongate element of high porosity material, with at least a first end shaped to form a writing tip.

In characteristic manner, the pores and/or capillaries of said material are blocked over a limited thickness e at the longitudinal outer periphery of the elongate element, with the exception of the first end.

For an elongate element of circular cross-section, having a diameter lying in the range 2 mm to 15 mm, the thickness e preferably lies in the range 0.01 mm to 1 mm.

In a first variant embodiment, the nib includes a sealing agent which blocks the pores and/or the capillaries of said material over said thickness e.

This variant is particularly suitable when the elongate element is a rod that is constituted by fibers that have previously been held together by a binder. For acrylic fibers that are held together by a melamine formaldehyde (MF) resin, for example, the sealing agent can also be an MF resin. For polyester fibers, for example, the sealing agent can be either an acid-catalyzed melamine resin, or a melamine urea-formaldehyde resin, or a two-component epoxy resin, or a two-component polyurethane resin.

In a second variant embodiment, the elongate element is constituted by a hot-melting material, and the pores and/or capillaries are blocked by localized hot-melting of said material over said thickness e. This second variant is particularly suitable when the elongate element is constituted by sintered microbeads.

Another object of the invention is to propose methods of treating high-porosity elongate elements, designed to form the above-mentioned nibs, in accordance with the first and second variants.

In the first variant, the method of the invention consists firstly in continuously impregnating a coherent high-porosity, elongate element with a sealing bath having a sealing agent that is inert relative to the components of the ink, impregnation being performed under conditions of concentration, of surface tension, of viscosity, and of time in particular, such that said bath diffuses into the elongate element over a limited thickness e at its periphery, and said method consists secondly in setting the sealing agent.

During manufacture of the nib from the elongate element, said elongate element is cut into segments, and each segment is machined at least at the end designed to form the writing tip. As a result, the central zones of the cut and machined ends are exempt of sealing agent and enable ink to be transferred normally. In contrast, the sealing agent blocks the pores or capillaries on the surface of the elongate element, thereby creating a barrier preventing the ink solvent from evaporating.

Most nibs are constituted from fibers which are presented in the form of a tow or ribbon and which are joined and bonded together by a binder to form a coherent, elongate element referred to as a rod. In this case, said binder is preferably used as the sealing agent in the method of the invention. This particular disposition presents many advantages. The binders used to form nibs from fibers are well known. There is therefore no risk in choosing such binders as sealing agents with regard to the stability over time and the inertness with regard to the ink. In addition, manufacturers are entirely familiar with the techniques of cutting and machining nibs out of known fibers and binders. Thus, sealing the periphery of the nib with the same agent is therefore unlikely to disrupt the operation of conventional tooling to any significant extent, in contrast to what could happen if some other compound were to be used as the sealing agent.

For a nib based on acrylic fibers, in particular, the compound acting as binder and sealing agent is preferably an acid-catalyzed melamine resin.

The sealing agent is generally set merely by subjecting the elongate element to heat treatment (heating or cooling) after the impregnation operation.

In the second variant embodiment, the method of the invention consists in applying a thermal shock over the longitudinal periphery of the elongate element or of the segment of elongate element, with the exception of the first end which forms the writing tip, so as to obtain localized hot-melting of the hot-melting material over a thickness e.

The operating conditions of the shock treatment are a function of the material constituting the elongate element. For an elongate element made of polypropylene microbeads, in particular, the thermal shock is performed at a temperature lying in the range 200° C. to 300° C. for a period of 1 second (s) to 10 s.

BRIEF DESCRIPTION OF THE DRAWING

The present invention will be better understood on reading the following description of an implementation of the method for treating a rod of acrylic fibers for use in the manufacture of a nib, shown in the accompanying drawing, in which.

MORE DETAILED DESCRIPTION

Figure 1:
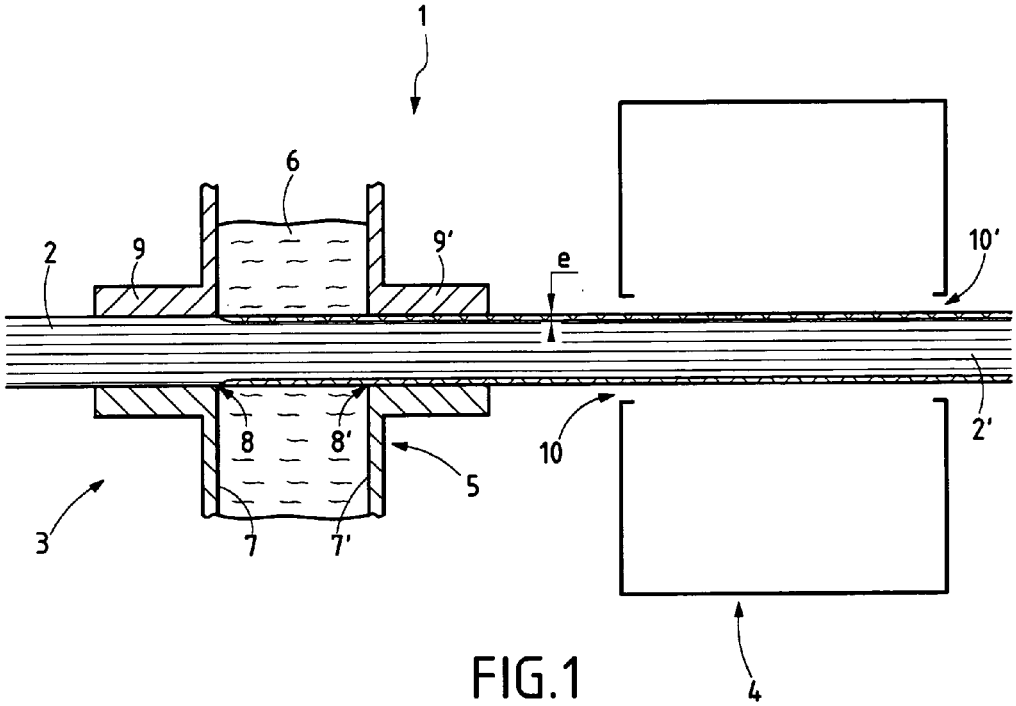
FIG. 1 is a diagram of an installation implementing said method.

In implements having liquid ink or a fibrous reservoir, the ink is transferred via a coherent high-porosity, elongate element enabling the ink to be transferred, by means of its capillarity, from the reservoir to the writing tip while said writing tip is consuming the ink.

In a first variant embodiment, the nib is made from a tow of continuous filaments or from a ribbon of discontinuous fibers, in particular acrylic fibers, juxtaposed and held together to form a coherent rod. The continuous rod is cut to form segments of determined length having at least one end that is machined to form the writing tip. The machining requirements are a function of the type of writing implement envisaged. The machining can form two beveled edges and a rounded end as in document EP 0 857 586 or any other appropriate shape.

The ink that is consumed by being deposited on a writing medium is replaced as it is being used by ink which diffuses into the nib through the pores and capillaries.

According to the invention, the rod from which the nibs are taken is subjected to special treatment for limiting the unacceptable phenomenon of the nib drying out when the implement remains uncapped, i.e. when the nib remains in the open air for a long period of time, e.g. several hours, or indeed several days.

In this first variant, the treatment of the invention consists in impregnating the rod as it moves continuously through a treatment bath containing a sealing agent. The term "sealing agent" refers to a compound that is suitable for filling the pores or capillaries of the material constituting the tow in such a manner that, once said compound has set, the pores or capillaries are plugged and a substantially airtight barrier is thus created preventing the ink solvent from evaporating or limiting evaporation thereof.

Once impregnated, the rod is subjected to an additional operation of setting the sealing agent. This operation depends on the type of compound used as the sealing agent in the treatment bath. It is generally heat treatment requiring a heat supply in order to evaporate the bath solvent, or in order to cross-link or polymerize the sealing agent, or it may even require cooling when the sealing agent is a paraffin that is applied when hot.

The operating conditions under which impregnation is performed must be determined in such a manner that the sealing agent is diffused over a limited thickness e at the longitudinal outer periphery of the tow. The thickness e must be sufficient to block the network of pores and capillaries at the surface completely and to create the barrier phenomenon. It is not desirable for the thickness e to be too thick insofar as the presence of the sealing agent correspondingly reduces the effectiveness of the rod with regard to its primary function which is to transfer ink by capillarity.

For a rod of circular section, having a diameter lying in the range 2 mm to 15 mm, it has been found that the diffusion thickness e for the sealing agent should lie in the range 0.01 mm to 1 mm.

FIG. 1 is highly diagrammatic and shows the two treatment stages of the invention using a device 1 successively comprising, along the path of the rod 2, an impregnation head 3 and a setting oven 4.

The impregnation head is constituted by a reservoir 5 containing the treatment bath 6. Two facing vertical walls 7, 7' of the reservoir 5 are pierced with two openings 8, 8' that are shaped exactly like the cross-section of the rod 2. Each opening 8, 8' is extended outwards by a shoulder 9, 9', in particular an annular shoulder when the cross-section of the rod is circular.

The method is implemented by inserting the rod 2 through the shoulders 9, 9' and the openings 8, 8' of the impregnation head, and through the openings 10, 10' of the setting oven 4.

The rod is drawn continuously through the impregnation head 3 and the setting oven 4.

As mentioned above, the size of the openings 8, 8' and of the shoulders 9, 9' matches the cross-section of the rod 2 in such a manner that the rod 2 itself cooperates with the inside wall of the shoulders 9, 9' to form a gasket, preventing the treatment bath 6 from escaping directly.

During continuous displacement of the rod 2 through the impregnation head 3, the treatment bath 6 naturally diffuses through the pores and the capillaries situated on the longitudinal outer periphery of the rod 2. The diffusion takes place over a thickness e. The sealing agent which is contained in the treatment bath and which has diffused over said thickness is then set by the tow 2 passing through the setting oven 4.

It is easy for the person skilled in the art to modify and control the thickness e by adjusting various parameters which influence the diffusion of the treatment bath and thus of the sealing agent, in particular the viscosity of the bath, the contact time, the surface tensions of the rod and of the bath, and the concentration of sealing agent (dry extract) in the bath.

The function of the sealing agent is to block the pores and/or capillaries which are situated on the outer peripheral surface of the tow 2. It is essential for the sealing agent to be insoluble and chemically inert relative to the various constituents of the ink which is to be used in the writing implement, and in particular relative to the solvent of said ink.

The sealing agent can be a paraffin having a very high melting point, e.g. lying in the range 67° C. to 70° C., which is used in a writing implement having an alcohol-based ink. The sealing agent could be a two-component epoxy or polyurethane resin.

However, when the rod 2 is made of fibers that are bound together, the same compound that serves as a binder for the fibers is preferably also used as the sealing agent.

Given that such binders are already used by manufacturers of nibs, said manufacturers are perfectly aware of their insolubility and their chemical inertness relative to the inks used. In addition, manufacturers are entirely familiar with the cutting and machining operations to be performed on the corresponding rods, so they can easily adapt the cutting and the machining of rods to the invention since the compounds are the same and only the quantity of binding/sealing agent is increased. This avoids the risks inherent in introducing some other compound, in particular the risks of clogging the various tools serving to cut and machine the nib.

Figure 2:
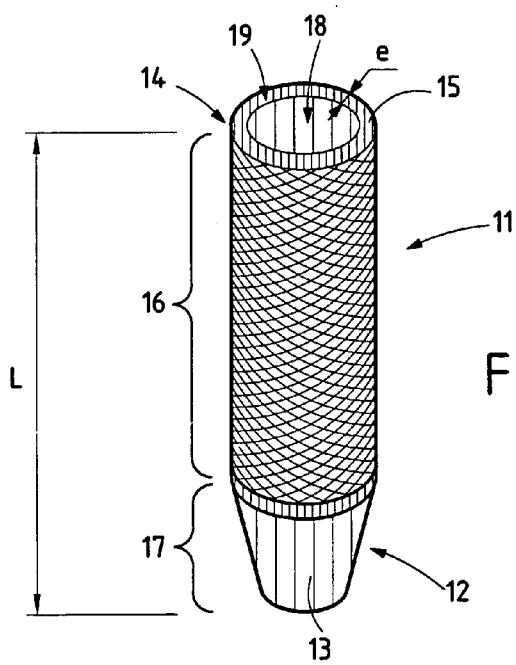
FIG. 2 is a perspective view of a nib obtained from the rod treated thereby.

The rod 2' obtained at the outlet of the setting oven is cut into segments of length L, each segment being designed to constitute a nib 11, as shown in FIG. 2.

In the example, only the front end 12 of the nib 11 is machined in order to form the writing tip 13, the rear end 14 resulting from the transverse cut of the rod 2'. The front end 12 is sharpened, with a rounded end forming the writing tip 13.

The nib 11 thus includes a cylindrical rear portion 16 and a converging front portion 17 terminated by the writing tip 13.

In the cylindrical rear portion 16, the pores or capillaries situated on the outer periphery are sealed by a sealing agent 15 over a thickness e.

When the nib 11 is assembled in a writing implement, it is filled with ink, in known manner, in the capillaries of the unsealed central zone of the fibers. The central zone 18 extends from the rear end 14 to the writing tip 13. In the cylindrical rear portion 16, the central zone 18 is surrounded by the outer peripheral zone 19 in which the sealing agent is situated, said peripheral zone creating a substantially airtight barrier preventing the ink solvent from evaporating or limiting evaporation thereof.

Thus, when the nib 11 is positioned in the writing implement, its rear end 14 comes directly into contact with the ink of the reservoir which diffuses by caprillarity through the unsealed fibers of the central zone 18 to the writing tip 13.

With regard to the portion that projects outside the body of the writing implement, only the converging front portion 17 includes ink-impregnated fibers which can be exposed directly to the open air. The person skilled in the art must choose the method of machining said portion 17 in such a manner as to limit the area which is exposed to the open air while maintaining an acceptable writing tip 13.

For a rod made of acrylic fibers, the sealing agent 15 is preferably an acid-catalyzed MF resin which is also used as a binder for binding the acrylic fibers together in the structure of the rod 2. The sealing agent can be an MF resin having 90% dry extract, e.g. as marketed by HOECHST in the MAPRENAL range or by MONSANTO in the RESIMENE range.

By way of example, the following conditions have been implemented with said MF resin: speed of displacement of the rod of 30 centimeters per minute (cm/mn) for an impregnation length of 3 cm; ambient temperature; viscosity of the bath adjusted with thixotropic agents (bentonite, silica, or polyurethane thickening) to approximately 10000 centipoise (cPo); and surface tension of the bath lying in the range 23 dynes per centimeter (dyn/cm) to 25 dyn/cm.

For a rod made of polyester fibers, the sealing agent is preferably an acid-catalyzed melamine resin, a melamine urea-formaldehyde resin, a two-component epoxy resin, or a two-component polyurethane resin.

In a second variant embodiment, the nib is made from sintered microbeads. In this case, the microbeads are placed in a mold having an inside configuration that is the configuration desired for the nib, and sintering is obtained by an appropriate heat treatment enabling the desired microporous structure to be achieved through the interconnection of the various microbeads.

In this second variant, the treatment method of the invention consists in applying a thermal shock over the segment of elongate element, with the exception of the first end which forms the writing tip and with the exception of the transverse face of the second end, so as to obtain localized hot-melting of the microbeads at the longitudinal periphery of the segment over a limited thickness e. Said thermal shock is applied under operating conditions that are determined so that the localized hot-melting of the microbeads enables the surface pores of the elongate element to be blocked. In this case, there is therefore no need to add a sealing agent, since the constituent material of the microbeads is used as the sealing agent for the surface pores.

In an embodiment in which the microbeads-are made of polyproylene, the thermal shock is performed at a temperature lying in the range 200° C. to 300° C., and preferably about 270° C., for a period of 1 s to 10 s, and preferably about 5 s.

It should be noted that localized hot-melting on the surface of the microbeads has the secondary technical effect of increasing the strength of the elongate element. Until now, for an elongate element made from sintered microbeads, its porosity was limited because of insufficient strength. By increasing its strength by means of the hot-melted peripheral zone, it becomes possible to increase the porosity of the middle zone which transfers the ink correspondingly. The same result could possibly be obtained by implementing the method of the first variant, namely impregnation with a sealing agent.

What is claimed is:

1. A method of treating a coherent high porosity, elongate element designed to form a nib, the method comprising the steps of:

from an elongate element which is a rod constituted by fibers that have previously been held together by a binder, continuously impregnating said elongate element with a sealing bath having a sealing agent that is inert relative to the components of the ink, impregnation being performed under conditions of viscosity, of time, of surface tensions, and of concentration in particular, such that said bath diffuses into the elongate element and fills the pores or capillaries of the rod over a limited thickness of its longitudinal periphery, said limited thickness ranging from about 0.01 mm to about 1 mm; and setting the sealing agent in such a manner that the pores or capillaries are plugged and a substantially airtight barrier is created preventing the ink solvent from evaporating or limiting evaporation thereof.

2. The method according to claim 1, wherein the same compound that serves as a binder for the fibers is also used as the sealing agent.

3. The method according to claim 2, wherein the rod is based on acrylic fibers, and the binder and the sealing agent are an acid-catalyzed melamine formaldehyde resin.

4. The method according to claim 2 wherein the rod is based on polyester fibers and the sealing agent is an acid-catalyzed melamine resin, a melamine urea-formaldehyde resin, a two-component epoxy resin, or a two-component polyurethane resin.

5. The method according to claim 1, wherein the sealing agent is set by subjecting the elongate element to heat treatment.

6. The nib obtained by cutting into segments and machining a high porosity elongate element treated according to the method of claim 1.

7. The method according to claim 1, wherein the rod has a diameter lying in the range of 2 mm to 15 mm and the limited thickness lies in the range of 0.01 mm to 1 mm.

* * * * *

UNITED STATES PATENT AND TRADEMARK OFFICE

CERTIFICATE OF CORRECTION

PATENT NO. : 6,893,181 B1
APPLICATION NO. : 10/009885
DATED : May 17, 2005
INVENTOR(S) : José Duez et al.

It is certified that error appears in the above-identified patent and that said Letters Patent is hereby corrected as shown below:

Front page, Abstract (57), line 4, “e” should read - - e - - ;

Column 1, line 61, “e” should read - - e - - ;

Column 1, line 66, “e” should read - - e - - ;

Coulmn 2, line 3, “e” should read - - e - - ;

Column 2, line 16, “e” should read - - e - - ;

Column 2, line 30, “e” should read - - e - - ;

Column 3, line 2, “e” should read - - e - - ;

Column 3, line 67, “e” should read - - e - - ;

Column 4, line 1, “e” should read - - e - - ;

Column 4, line 4, “e” should read - - e - - ;

Column 4, line 10, “e” should read - - e - - ;

Column 4, line 37, “e” should read - - e - - ;

Column 4, line 42, “e” should read - - e - - ;

Column 5, line 20, “e” should read - - e - - ;

Column 6, line 4, “e” should read - - e - - ; and

UNITED STATES PATENT AND TRADEMARK OFFICE

CERTIFICATE OF CORRECTION

PATENT NO. : 6,893,181 B1
APPLICATION NO. : 10/009885
DATED : May 17, 2005
INVENTOR(S) : José Duez et al.

It is certified that error appears in the above-identified patent and that said Letters Patent is hereby corrected as shown below:

Column 6, claim 7, lines 65-66, delete "and the limited thickness lies in the range of 0.01 mm to 1 mm".

Signed and Sealed this

Fifteenth Day of August, 2006

JON W. DUDAS
*Director of the United States Patent and Trademark Office*